United States Patent [19]

Pokalsky

[11] Patent Number: 4,642,613

[45] Date of Patent: Feb. 10, 1987

[54] ELECTRONIC THEFT DETECTION APPARATUS WITH RESPONDER ELEMENTS ON PROTECTED ARTICLES

[75] Inventor: Peter A. Pokalsky, East Meadow, N.Y.

[73] Assignee: Knogo Corporation, Hicksville, N.Y.

[21] Appl. No.: 590,346

[22] Filed: Mar. 16, 1984

[51] Int. Cl.[4] ..... G08B 13/24

[52] U.S. Cl. ..... 340/572

[58] Field of Search ..... 340/572, 551; 343/3.6 SS, 6.8 R, 6.8 LC, 741, 742, 841, 842; 455/90

[56] References Cited

U.S. PATENT DOCUMENTS

| | | | |
|---|---|---|---|
| 2,461,646 | 2/1949 | Lewis | 250/6 |
| 2,511,409 | 6/1950 | Mayberry | 250/36 |
| 2,812,427 | 11/1957 | Magondeaux | 250/6 |
| 2,899,546 | 8/1959 | Hollmann | 250/6 |
| 2,958,781 | 11/1960 | Marchal et al. | 250/83.3 |
| 3,117,277 | 1/1964 | de Magondeaux | 325/6 |
| 3,218,638 | 11/1965 | Honig | 343/6.5 |
| 3,253,588 | 5/1966 | Vuilleumier et al. | 128/2 |
| 3,299,424 | 1/1967 | Vinding | 343/6.5 |
| 3,363,246 | 1/1968 | Gareis et al. | 343/6.5 |
| 3,363,247 | 1/1968 | Chausse et al. | 343/6.5 |
| 3,373,425 | 3/1968 | Barischoff | 343/6.8 |
| 3,440,633 | 4/1969 | Vinding | 340/258 |
| 3,500,373 | 3/1970 | Minasy | 340/258 |
| 3,740,742 | 6/1973 | Thompson et al. | 340/280 |
| 3,765,007 | 10/1973 | Elder | 340/280 |
| 3,820,103 | 6/1974 | Fearon | 340/280 |
| 3,820,104 | 6/1974 | Fearon | 340/280 |
| 4,016,553 | 5/1977 | Novikoff et al. . | |
| 4,134,538 | 1/1979 | LaGarde et al. | 340/572 X |
| 4,135,183 | 1/1979 | Heltemes | 340/572 |
| 4,251,808 | 2/1981 | Lichtblau | 340/572 |
| 4,384,281 | 5/1983 | Cooper | 340/572 |
| 4,476,459 | 10/1984 | Cooper et al. | 340/572 |
| 4,509,039 | 4/1985 | Doudle | 340/572 |

FOREIGN PATENT DOCUMENTS

| | | |
|---|---|---|
| 763681 | 5/1934 | France . |
| WO/8302027 | 9/1983 | PCT Int'l Appl. . |
| 906006 | 9/1962 | United Kingdom . |
| 1085704 | 10/1967 | United Kingdom . |
| 1298381 | 11/1972 | United Kingdom . |

OTHER PUBLICATIONS

H. E. Haynes and A. L. Witchey, "Medical Electronics: The Pill that 'Talks'", *RCA Engineer*, pp. 52–54, vol. 5, No. 5, Feb.–Mar. 1960.

John T. Farrar, Carl Berkley and Vladimir K. Zworykin, "Telemetering of Intraenteric Pressure in Man by an Externally Energized Wireless Capsule", *Science*, p. 1814, vol. 131, Jun. 1960.

*Primary Examiner*—James L. Rowland
*Assistant Examiner*—Brian R. Tumm
*Attorney, Agent, or Firm*—Fitzpatrick, Cella, Harper & Scinto

[57] ABSTRACT

A self contained electronic theft detection apparatus comprising a housing (30) from which a rigid tubular transmitter antenna loop (32) extends; and a wire loop receiver antenna (56) extends inside the transmitter antenna loop. The transmitter antenna (32) is provided with a capacitor (C54) with which it resonates at the frequency of responder elements to be detected and the transmitter antenna is supplied with sharp voltage pulses from a pulse forming circuit (66) and a power amplifier (68) which cause the antenna to resonate in a rapidly decaying manner.

14 Claims, 9 Drawing Figures

Fig. 1.
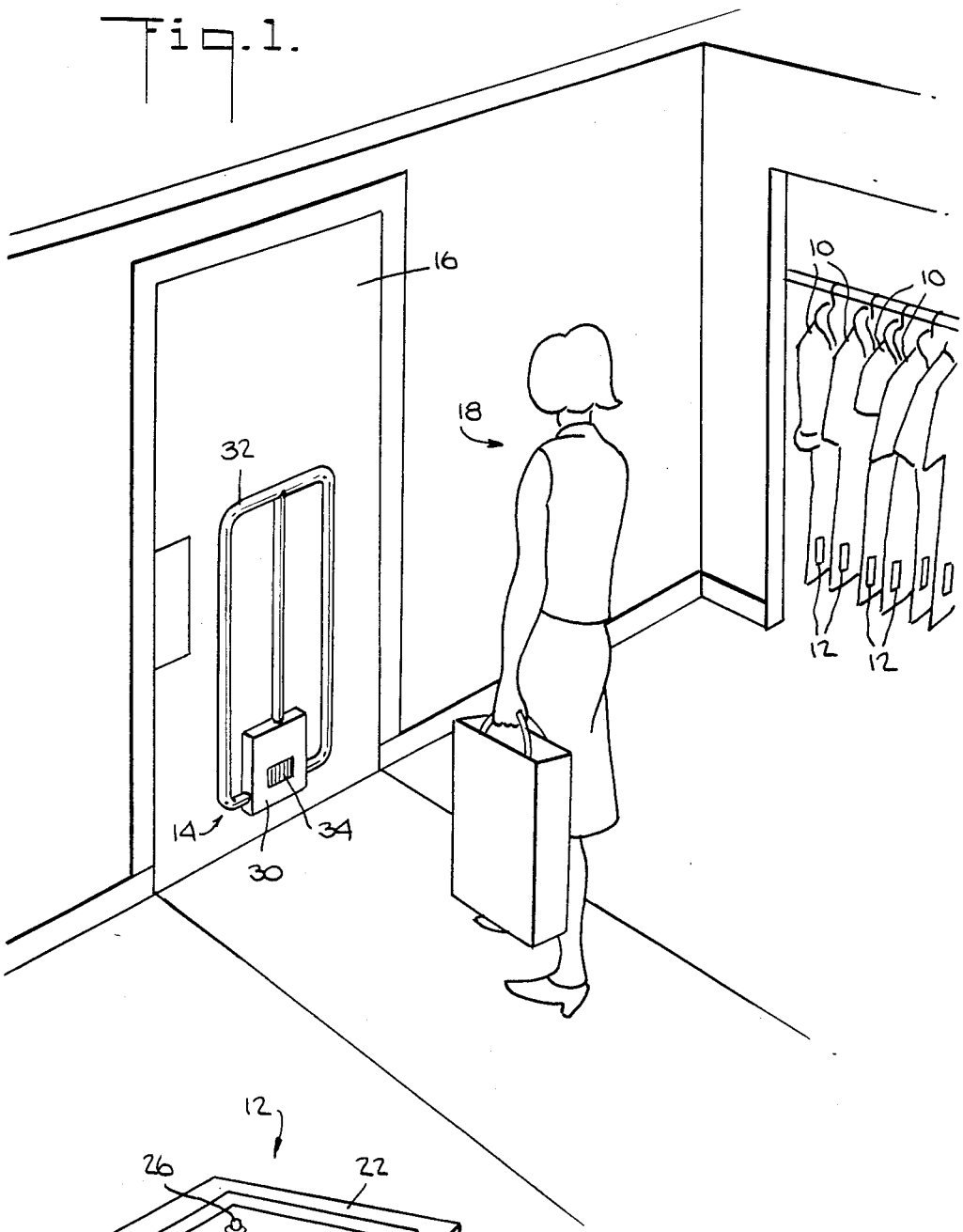
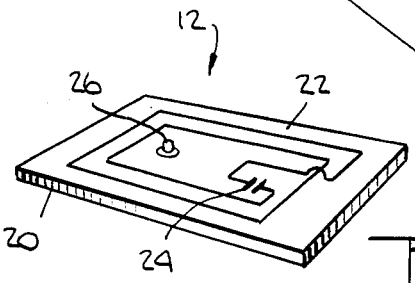
Fig. 2.

32
C54
68
C52
CR12
R67
24V
C53
Q14
Q15
R66
R63
POWER AMP.
TO ANALOG SWITCH 82
C55
+5V
(c)
(d)
(g)
(h)
(e)
(a)
U4
14
15
13
8
R92
R91
COUNTER DECODER 64
C35
R64
Q12
Q13
R65
-5V
C34
R61
R59
C56
Q10
Q11
PULSE FORMING CIRCUIT
66
CLOCK 62
R85
C47
C48
L3
R81
C49
+15
R87
C50
R88
Q21
R86
Q20
R83
R82
R80
C51
C46
-5V

ELECTRONIC THEFT DETECTION APPARATUS WITH RESPONDER ELEMENTS ON PROTECTED ARTICLES

BACKGROUND OF THE INVENTION

1. Field of the Invention This invention relates to article theft detection and more particularly it concerns novel apparatus for electronically detecting the passage of protected articles through an interrogation zone such as the exit from a store or other protected area.

2. Description of the Prior Art

U.S. Pat. No. 3,740,742 to Thomas F. Thompson and Joseph W. Griffith describes apparatus for detecting the passage of a resonant electronic responder circuit through an aisle in a store through which customers must pass. Plates or coils are provided along the aisle and then are energized with pulses to produce sharp electrostatic or electromagnetic pulses in the aisle. These pulses cause resonant electrical responder circuits, attached to the protected articles carried through the aisle, to resonate for a duration following each pulse. A receiver is provided to detect the resultant radiation from the resonant responder circuits and the receiver is gated to detect signals only after the energizing pulse has terminated.

Other apparatus which detect resonant electrical responder circuits by generating pulses and monitoring the resulting radiation from the resonating circuits are shown and described in U.S. Pat. Nos. 2,812,427, 2,899,546, 2,958,781, 3,117,277, 3,218,638, 3,299,424, 3,363,246, 3,363,247, 3,373,425, 3,440,633 and 3,740,742.

Similar resonant responder circuit detection techniques as applied to medical diagnosis are described in U.K. Pat. No. 906,006 and in Publications entitled "Medical Electronics: The Pill that 'Talks'" by H. E. Haynes and A. L. Witchey, pp. 52–54, *RCA Engineer,* Vol. 5, No. 5, February–March 1960 and "Telemetering of Intraenteric Pressure in Man by an Externally Energized Wireless Capsule" by John T. Farrar, Carl Berkley and Vladimir K. Zworykin p. 1814, *Science,* Vol. 131, June 17, 1960.

In addition, U.S. Pat. No. 4,476,459 in the name of Michael N. Cooper describes a pulsed detection arrangement wherein the characteristic decay of the signal from the resonant responder circuit is monitored and utilized to distinguish the circuit from other energy sources which may produce the same frequency.

In all of the foregoing pulsed detection arrangements the pulses of electromagnetic energy are generated either by turning an oscillator on and off or by causing a sudden flow of current through a transmitter antenna coil or through a pair of electrostatic antenna plates. The devices which utilize oscillators usually incorporate a tuned transmitter antenna circuit having a Q value substantially less than that of the resonant responder circuits. These devices are complex and expensive. They also require relatively long pulsing intervals and therefore the amount of time available for monitoring the decaying resonance of the responder circuits is limited. The devices which cause a sudden flow of current through a coil or a pair of plates have the advantage of simplicity and economy. Also, these devices produce an interrogation pulse which lasts less than one cycle of the responder circuit resonant frequency and so provide maximum time to monitor the response. However, the frequency spectrum of the interrogation pulse is quite wide and a large amount of energy is wasted in generating unused frequency components.

Prior art responder detection arrangements also utilize either a common antenna for both generation of the pulsed electromagnetic field and for reception of resonant circuit responses or they use separate transmitter and receiver antennas. While the common antenna provides the advantage of being relatively simple and compact, the separate transmitter and receiver antennas are preferable because the transmitter antenna should be in the form of a simple loop coil to maximize pulse energy throughout the interrogation region while the receiver antenna should be in the form of dual cancelling coils to protect against interfering radiation from remote sources. Separate transmitter and receiver antennas are usually arranged on opposite sides of an aisleway although it has been proposed, for example in French Pat. No. 763,681 and U.S. Pat. Nos. 3,169,242 and 3,765,007 to locate them adjacent each other. However, such an arrangement requires a complex and cumbersome supporting structure. It has also been known to provide self supporting antennas in the form of metal pipes or bands, for example, as shown in U.S. Pat. Nos. 4,384,281, 3,820,103 and 3,820,104 and British Pat. No. 1,085,704; and it has also been proposed to mount an antenna inside a metal pipe, for example as shown in U.S. Pat. No. 4,251,808. None of these arrangements, however, permit the effective integral mounting of separate transmitter and antennas in a simple structure.

SUMMARY OF THE INVENTION

In one aspect, the present invention provides novel arrangements for mounting the separate transmitting and receiving antennas of an electronic article surveillance apparatus in a manner such that the antennas are maintained together in a self supporting manner without need for any external supporting construction.

According to this aspect, there is provided in an electronic surveillance apparatus for detecting the unauthorized movement of protected articles through a passageway, a transmitter for producing electromagnetic waves in the passageway, electronic responder circuits constructed and arranged to be mounted on protected articles and to produce characteristic disturbances of the electromagnetic waves when one of the articles is present in the passageway, a receiver constructed and arranged to sense the occurrence of the characteristic disturbance and to produce an alarm in response thereto, a transmitter antenna connected to the transmitter and a receiver antenna connected to the receiver. One of the antennas comprises a loop of an electrically conductive, non-magnetic, self supporting material and the other antenna comprises an electrically conductive wire loop supported by the self supporting material. In a preferred embodiment, the antenna formed of the self supporting material comprises a hollow tubular element and the other antenna extends inside and is supported by the hollow element.

In another aspect, the present invention provides novel arrangements for generating bursts of electromagnetic wave energy in an aisleway or other interrogation zone through which resonant responder circuits carried on protected merchandise must pass in leaving a protected area. These novel arrangements are simple and economical in construction; and at the same time they maintain the bursts of electromagnetic wave energy within a very narrow frequency spectrum in the vicinity of the resonant frequency of the responder circuits for a duration only long enough to produce maximum resonance of the responder circuits.

According to this second aspect of the invention there is provided an electronic article surveillance apparatus for detecting the unauthorized passage of articles through a passageway which comprises a transmitter for producing in the passageway successive bursts of electromagnetic wave energy at a predetermined frequency. Responder elements are constructed and arranged to be fastened to articles which may be carried through the passageway. These responder elements contain resonant electrical responder circuits tuned to resonate at the predetermined frequency. A receiver is positioned and arranged to respond to electromagnetic wave energy at the predetermined frequency which occurs in the passageway in the intervals between successive bursts from the transmitter. The transmitter has a resonant antenna circuit which comprises a loop of electrically conductive material and a capacitor connected to the loop. The antenna loop and the capacitor are tuned to resonate at the predetermined resonant frequency of the resonant responder circuits. The Q value of the resonant antenna circuit is substantially less than the Q value of the resonant responder circuits. A pulse generator is connected to apply to the resonant antenna circuit voltage pulses having a duration less than one cycle of the predetermined frequency to cause the resonant antenna circuit to resonate in a decaying manner for a number of cycles at the predetermined frequency.

There are other features and advantages of the invention which are described more specifically in the following detailed description of the preferred embodiment.

BRIEF DESCRIPTION OF THE DRAWINGS

A preferred embodiment of the invention has been chosen for purposes of description and illustration and is shown in the accompanying drawings in which:

FIG. 1 is a perspective view showing an embodiment of the invention as mounted on a doorway at the exit from a store;

FIG. 2 is a perspective view of a responder element and showing schematically a resonant responder circuit forming part of the embodiment of FIG. 1;

FIG. 8 is a detailed schematic of the transmitter portion of the block diagram of FIG. 6.

DETAILED DESCRIPTION OF THE PREFERRED EMBODIMENT

Figure 3:
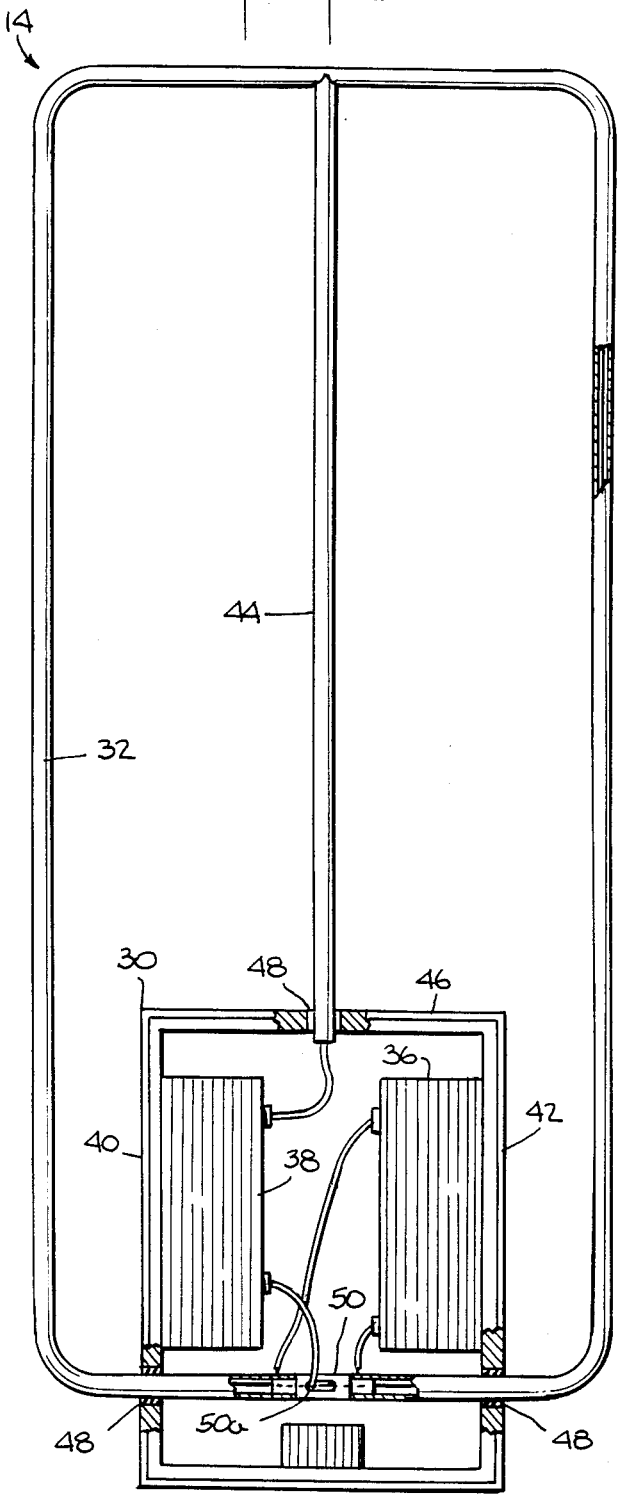
FIG. 3 is an enlarged front elevational view, partially cut away, showing a housing and antenna arrangement for the embodiment of FIG. 1.

In FIG. 1 there is shown the interior of the protected area, such as the interior of a store, in which merchandise, such as garments 10 is displayed. The garments 10 have resonant responder elements 12 fastened to them. These responder elements may take the form of labels or tags and they have embedded in them resonant electronic circuits which interact with and disturb an interrogating electromagnetic field in a characteristic manner. The responder elements 12 are attached to the garments 10 with special fasteners so that they cannot be removed except by a special tool in the possession of a salesperson at a sales counter.

An electronic monitoring apparatus 14 embodying the invention is mounted on a door 16 leading from the protected area. When a patron 18 leaves the protected area, he or she must open the door 16 and pass very close to the monitoring apparatus 14.

The monitoring apparatus 14 produces an electromagnetic interrogating field in the form of a series of bursts of energy. Each burst comprises a number of cycles e.g. three to five, of electromagnetic energy at a predetermined frequency, e.g. 3.25 MHZ (megahertz). Each burst last for a duration of 0.9 to 1.5$\mu$ sec. (microseconds) and the bursts themselves occur at a 20 KHZ (kilohertz) rate and are spaced apart by about 50$\mu$ sec. The frequencies chosen are not critical to this invention.

Turning now to FIG. 2, it will be seen that the responder element 12 comprises a plastic wafer 20 having embedded therein a coil 22 and a capacitor 24 connected to form a resonant circuit and turned to resonate at the frequency of the interrogating electromagnetic field e.g. 3.25 MHZ. A lock housing 26 is formed in the wafer 20 and houses a locking mechanism by which the wafer is securely attached to articles of merchandise. The specific construction of the responder element and the locking mechanism is not critical to this invention and examples of such devices are shown in U.S. Pat. Nos. 4,187,509 and 3,911,534.

When a patron 18 carries a garment 10 having an attached responder element 12 past the door 16, the resonant circuit formed by the coil 22 and capacitor 24 passes within the electromagnetic interrogating field generated by the electronic monitoring apparatus 14 mounted on the door; and each burst of the electromagnetic interrogating field drives the resonant circuit in the responder element 12 into resonance. The Q value of the resonant circuit, which typically is in the range of 80–150, is high enough so that the circuits will continue to resonate for a time after the burst has subsided; and during this time the responder circuit itself generates a detectable electromagnetic field at its resonant frequency.

As can be seen in FIG. 1, the electronic monitoring apparatus 14 comprises a box-like housing 30 from which extends a pipe-like transmitter antenna 32. A speaker 34 on the housing emits an acoustical alarm when a resonant responder element is detected. Visual alarms can also be provided.

Figure 4:
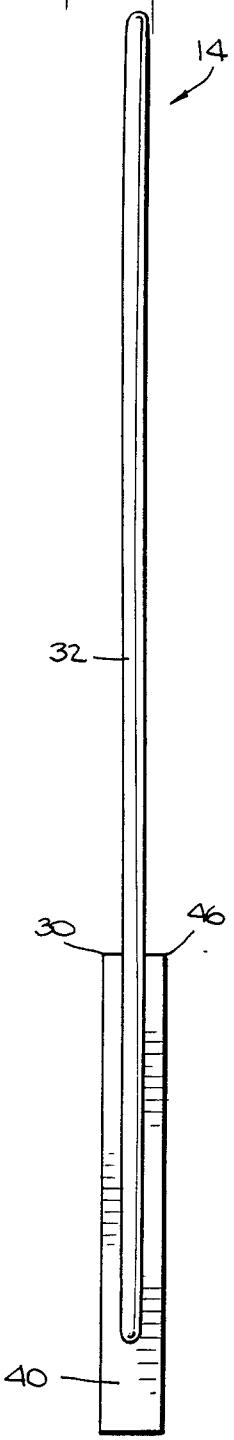
FIG. 4 is a side elevational view of the housing and antenna arrangement of FIG. 3.
Figure 5:
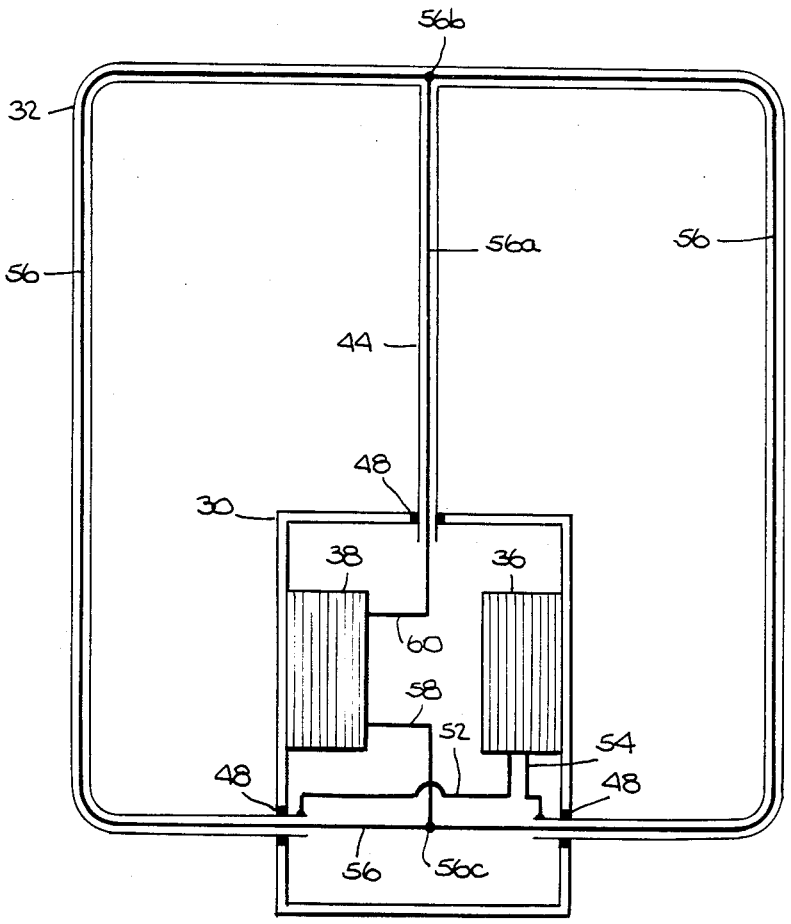
FIG. 5 is a schematic showing the antenna wiring arrangement for the embodiment of FIG. 1.

Turning now to FIG. 3–5 it will be seen that a transmitter 36 and a receiver 38 are arranged inside the housing 30. It should be understood that the transmitter 36 and the receiver 38 are represented only symbolically in FIG. 5 and that the actual electrical components of these items are not necessarily grouped in different locations within the housing 30. The transmitter antenna 32 extends as a vertically elongated loop with its lower end extending into the housing side walls 40 and 42. The transmitter antenna 32 itself may be made of aluminum or other readily conductive, non-magnetic material. Alumminum tubing of five eighths inch (1.58 cm) outside diameter and one sixteenth inch (1.6 mm) wall thickness is preferred. The transmitter antenna loop is of generally rectangular configuration and is elongated in the vertical direction. In the illustrative embodiment the height of the vertical loop is forty eight inches (1.22 meters) and its overall width is eighteen inches (46 cm). The rectangular antenna loop is bisected by a central vertical arm 44 of the same material which is connected to the center of the top portion of the loop and extends down to a top wall 46 of the housing 30.

The housing 30 itself is of aluminum material and is approximately ten inches (25 cm) wide, fourteen and one half inches (37 cm) high and one quarters inches (6.4 mm) thick. The housing side and top walls 40, 42 and 46 are provided with electrically insulative phenolic bushings 48 where the transmitter antenna 32 and its central vertical arm 44 enter the housing. As shown, the central vertical arm 44 terminates just inside the housing 30 while the bottom ends of the antenna loop are joined together via a tubular insulative phenolic spacer 50 inside the housing. It will be appreciated that the transmitter antenna and housing together form a unitary compact and self supporting rigid structure.

As shown in FIGS. 3 and 5, the transmitter 36 is connected via leads 52 and 54 to the ends of the transmitter antenna loop at the opposite ends of the insulative spacer 50 inside the housing 30.

As shown in FIG. 5, an insulated wire receiver antenna 56 extends through the hollow transmitter antenna 32 and the tubular insulative spacer 50 in the form of a continuous closed loop. This loop is bisected by a central vertical portion 56*a* which is connected to and extends between upper and lower junctions 56*b* and 56*c* at the top and bottom of the receiver antenna loop 56. The upper part of the central vertical portion 56*a* extends through the central vertical arm 44 of the transmitter antenna 32 and the lower part of the central vertical portion 56*a* extends through an opening 50*a* in the tubular insulative spacer 50. The central vertical portion 56*a* of the receiver antenna is broken inside the housing 30 and the ends thereof are connected via leads 58 and 60 to the receiver 38.

In the above described antenna arrangement the transmitter antenna 32 serves as a single turn loop or coil. The central vertical arm 44 is not connected electrically inside the housing 30 and therefore performs no electrical function. The receiver antenna 56, however, is in the form of two single turn bucking loops. This means that electromagnetic waves originating from remote locations and applied equally to both loops will produce equal but oppositely directed electrical currents in the two loops which will cancel. However, electromagnetic waves originating in the vicinity of the monitoring apparatus 14 will produce stronger effects in one receiver antenna loop than the other so that a finite electrical signal will be applied to the receiver.

It will be appreciated that the transmitter antenna 32 serves as a support and a housing for the receiver antenna 56 which does not have to be rigid or especially sturdy. Moreover, the transmitter antenna 32 is electrically invisible to received electromagnetic waves and does not interfere with the performance of the receiver antenna. Thus this invention combines the compactness and convenience of a single antenna system with the performance of a two antenna system.

Figure 6:
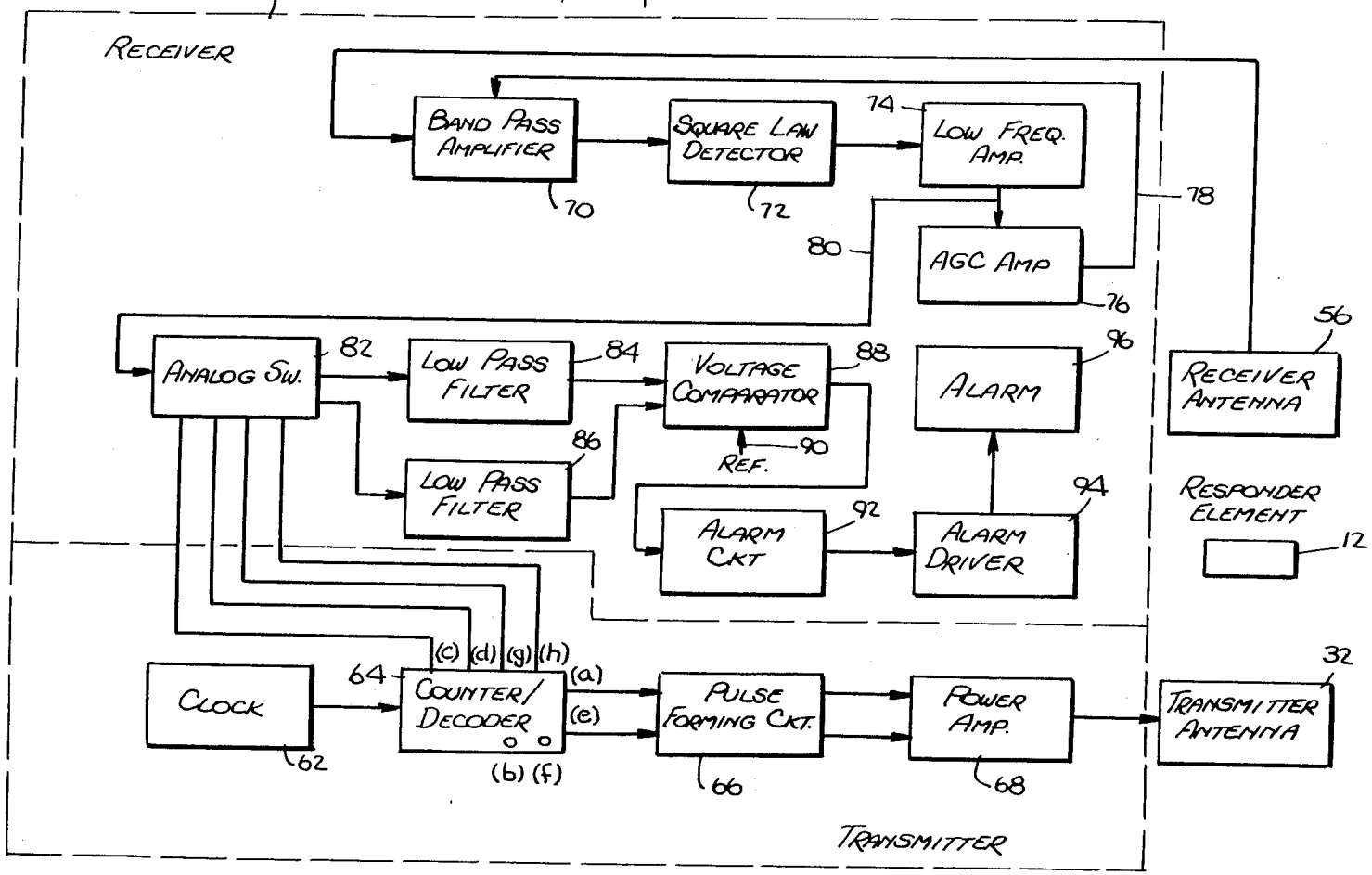
FIG. 6 is a block diagram of the embodiment of FIG. 1.

The components of the transmitter 36 and receiver 38 are shown in greater detail in the block diagram of FIG. 6. As can be seen, there is provided a clock 62 which is connected to a counter-decoder 64. The clock 62 generates pulses at a rate of about 100 kilohertz which it supplies to the counter-decoder 64. The counter-decoder 64 divides these pulses by eight and produces output pulses in succession at eight different output terminals (a), (b), (c), (d), (e), (f), (g) and (h). Two of the output terminals (a) and (e) are connected to a pulse forming circuit 66 which produces very sharp spike pulses. These spike pulses are amplified in a power amplifer 68 and are then supplied to the transmitter antenna 32. The transmitter antenna converts each pulse to a rapidly decaying oscillation at the resonance frequency of the resonant responder elements 12. These oscillations produce corresponding short duration electromagnetic interrogation fields which induce electrical currents in the resonant circuit in any responder element 12 which is in the vicinity of the transmitter antenna. The resonant circuit in the responder element thereby disturbs the electromagnetic interrogation field by radiating electromagnetic fields of its own at its resonant frequency. These radiated fields from the responder element resonant circuit continue for a substantial duration following decays of the electromagnetic field from the transmitter antenna 32 because the Q of the responder element resonant circuits is much greater than the Q of the transmitter antenna. As a result, the continued resonance of the responder circuit after decay of the electromagnetic field from the transmitter antenna causes an additional electromagnetic field which is received by the receiver antenna 56 and detected in the receiver 56.

The receiver antenna 56, as shown in FIG. 6, is connected to a variable gain band pass amplifier 70. Signals which pass through the amplifier 70 are detected in a square law detector 72 and are amplified in a low frequency amplifier 74. The output from the amplifier 74 is amplified in an automatic gain control amplifier 76 and is fed back, via a gain control line 78, to adjust the gain of the band pass amplifier 70. Another output of the low frequency amplifier 74 is applied via a line 80 to an analog switch 82, and from there to first and second accumulators or low pass filters 84 and 86.

Four other output terminals (c), (d), (g) and (h) of the counter-decoder 64 are connected to the analog switch 82. The signals on these terminals cause the switch 82 to direct signals from the low frequency amplifier 74 into the first and second accumulators or low pass filters 84 and 86 at predetermined times. These accumulators of filters accumulate electrical charges according to the signals from the low frequency amplifier 74 which are applied to them at the times determined by the signals at the terminals (c), (d), (g) and (h) of the counter-decoder 64. The other output terminals (b) and (f) of the counter-decoder 64 are not connected to any other circuit. The charges accumulated in the accumulators or filters 84 and 86 are compared in a voltage comparator 88. When the voltage charge in the first accumulator or low pass filter 84 exceeds that accumulated in the second accumulator or low pass filter 86 by a predetermined amount (corresponding to a reference input 90), an output is produced by the voltage comparator. This output is applied to an alarm circuit 92 which causes the output to be extended in time. This extended output is applied to an alarm driver 94 which activates an alarm 96.

Figure 7:
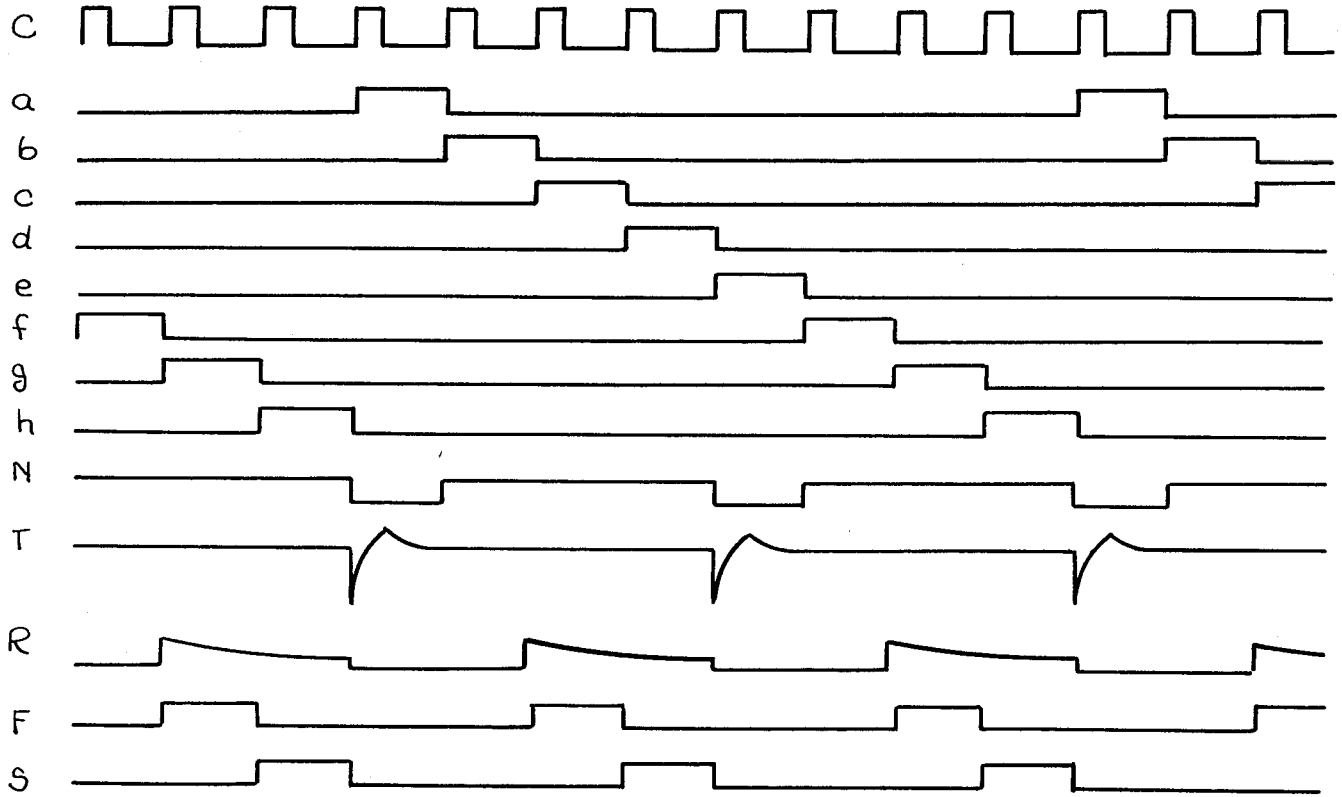
FIG. 7 is a series of waveforms useful in understanding the operation of the block diagram of FIG. 6.
Figure 6:
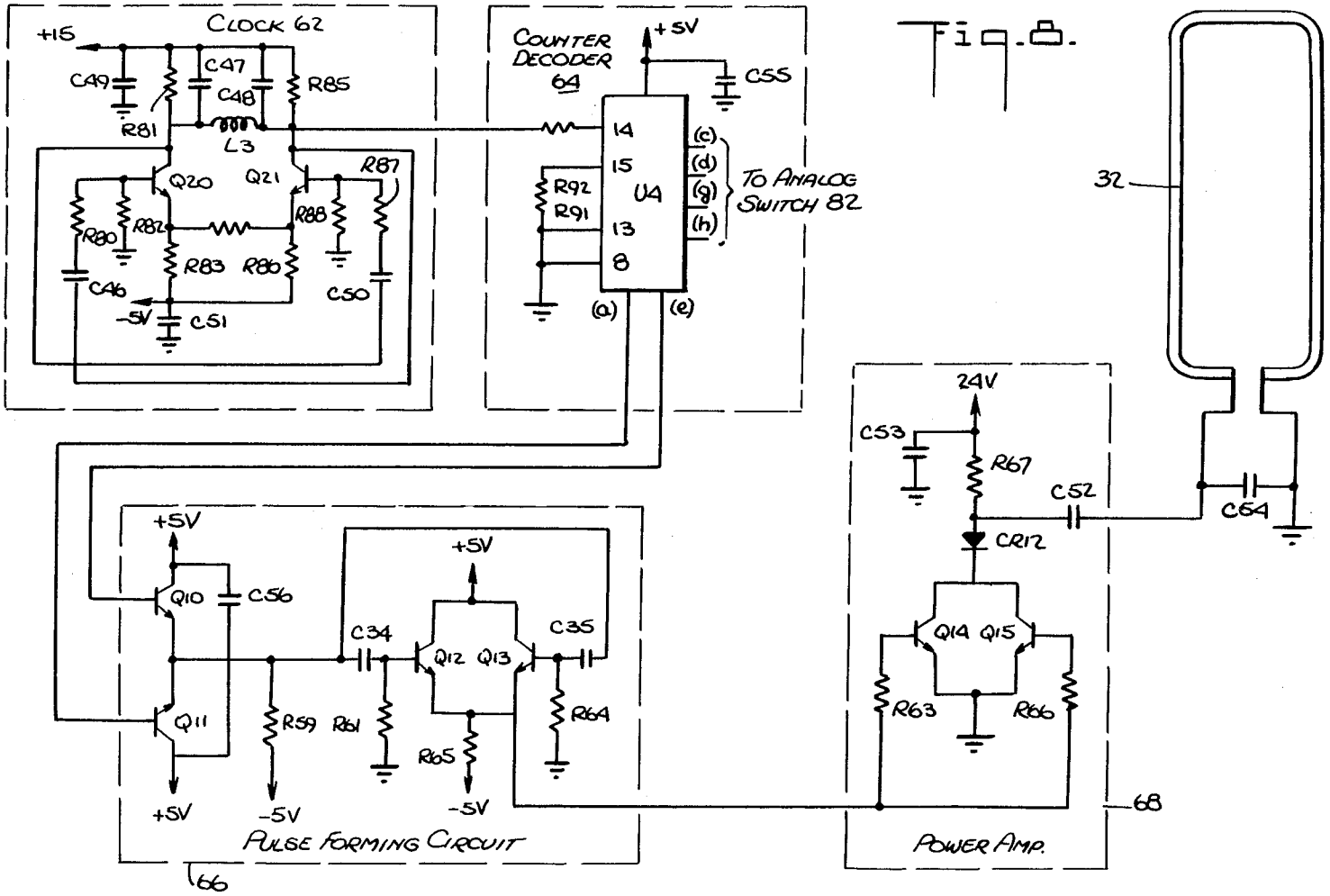

The manner in which the detection device operates to detect the electromagnetic disturbances produced by the resonant responder element 12 can be seen in the timing diagram of FIG. 7. As pointed out above, the clock 62 produces pulses at a rate of about 100 KHZ. These pulses, which are shown at curve C in FIG. 7, are spaced by ten microseconds ($\mu$ sec.) and they have a width of about 3$\mu$ sec. The counter-decoder 64 produces an output at each of its different outputs (a), (b), (c), (d), (e), (f), (g) and (h) in succession for the durations between successive pulses from the clock 62. These outputs are shown by corresponding curves (a), (b), (c), (d), (e), (f), (g) and (h) of FIG. 7.

Curve T of FIG. 7 represents the voltage applied to the transmitter antenna 32 from the pulse forming circuit 66 and the power amplifier 68. It will be seen that the transmitter antenna receives a large and very narrow negative spike voltage at the beginning of each pulse from the outputs (a) and (e) of the counter-decoder 40. These negative voltage spikes are preferably about 24 volts and they have a duration less than one half cycle of the resonant responder frequency i.e. 0.154$\mu$ sec.; and preferably the voltage spikes have a duration in the neighborhood of 0.075$\mu$ sec. As will be explained more fully hereinafter, these sharp negative voltage spikes cause the transmitter antenna 32 to generate interrogation bursts in the form of rapidly decaying electromagnetic fields in the vicinity of the door 16. The interrogation bursts are separated by intervals corresponding to four pulses from the clock 62 or about 33$\mu$ sec. If a garment 10 with a resonant responder element 12 attached is carried past the door 16 when these interrogation pulses are being generated, the resulting electromagnetic interrogation bursts will induce alternating current flow in the resonant circuit of the responder element. This induced current flow in the resonant responder circuit continues after each short duration interrogation burst has ended; and the amplitude of the alternating current flow in the resonant responder circuit diminishes at a rate corresponding to the Q of the circuit. The current flowing in the resonant responder circuit in turn produces a corresponding electromagnetic disturbance in the form of an electromagnetic field of gradually decaying amplitude in the vicinity of the responder element 12.

The gradually decaying electromagnetic field produced by the resonant responder circuit induces corresponding current flow in the receiver antenna 56. However, for the duration of the pulses (a) and (b) and the pulses (e) and (f) from the counter-decoder 64, i.e., a duration of about 20$\mu$ sec. following each interrogation burst, no enabling signal is applied to the analog switch 82 from the counter-decoder 64. As a result, during these time intervals no received signal passes through to the low pass filters 84 and 86. This effectively isolates the receiver from the large amplitude fields generated by the transmitter antenna 32. By preventing the band pass amplifier 70 from passing signals during the 20$\mu$ sec. period following the initiation of an interrogation pulse it is ensured that no transmitter generated disturbance will pass into the receiver.

Curve R of FIG. 7 represents the gradually decaying signal from the resonant circuit of the responder element 12 which passes into the receiver. The received signal is detected in the square law detector 72 and the low frequency amplifier 74 and is then applied to the analog switch 82. It will be noted that the received signal extends over the remainder of the interval between successive interrogation bursts and it decays at an exponential rate. This characteristic is unique to a high Q resonant circuit and it is the characteristic which is used to detect the electrical disturbance produced by the resonant responder circuit and isolate it from electrical noise. In the present embodiment the rate of decay of the signal represented by curve R of FIG. 7 is detected and when it is ascertained to be at a predetermined amount, i.e., corresponding to that of a resonant responder circuit, an alarm is activated. The amount of this decay is ascertained by directing the received signal into different accumulators or low pass filters 84 and 86 during different time segments in each interval between successive interrogation pulses and by comparing the amplitudes of the signals in the accumulators or filters 84 and 86. When that difference reaches a predetermined amount, the alarm 96 is actuated. The different time segments are established by the analog switch 82 which operates in response to signals from the counter-decoder 64 to direct signals corresponding to detected electromagnetic fields into the accumulators 84 and 86 at different time segments in each interval.

Curve F represents the voltages applied to the analog switch 82 from the outputs (c) and (d) of the counter-decoder 64; and curve S represents the voltage applied to the analog switch 82 from the outputs (g) and (h) of the counter-decoder 64. When the outputs (c) and (g) are positive, the analog switch 82 directs the detected signal from the low frequency amplifier into the first accumulator or low pass filter 84. Also, when the outputs (d) and (h) are positive, the analog switch 82 directs the detected signal from the low frequency amplifier into the second accumulator or low pass filter 86.

It will also be seen that by virtue of the outputs (c) and (g) from the counter-decoder 64, the analog switch 82 directs the detected receiver signals into the first accumulator or low pass filter 84 during the third 10$\mu$ sec. period following the initiation of each interrogation burst. Similarly, by virtue of the outputs (d) and (h), the detected receiver signals are directed into the second accumulator or low pass filter 86 during the fourth 10$\mu$ sec. period following the initiation of each interrogation burst.

Thus, after each interrogation burst, there is a delay of about 20$\mu$ sec. Then received and detected signals are directed into the first accumulator or low pass filter 84 for a duration of about 10$\mu$ sec. and thereafter the received and detected signals are directed into the second accumulator or low pass filter 86, also for a duration of about 10$\mu$ sec. When a resonant circuit responder element 12 has been energized by the interrogation burst, it will, because of its high Q, continue to resonate after the first 20$\mu$ sec. interval; but the amplitude of the field disturbance caused by its resonance will diminish at a predetermined rate, also dependent on its Q. Thus, during the third and fourth 10$\mu$ sec. durations following the interrogation burst, the amplitude of the detected signal voltage directed into the first accumulator or low pass filter 84 is greater than the amplitude of the detected signal voltage directed into the second accumulator or low pass filter 86. The signal voltages accumulated in the accumulators or low pass filters are compared in the voltage comparator 88; and, if the voltage in the first accumulator or low pass filter 84 exceeds that in the second accumulator or low pass filter 86 by the amount of a reference voltage applied to the reference terminal 90 of the comparator 88, the voltage comparator 60 will produce an alarm actuation output.

The output from the voltage comparator 88 may last for only a very small fraction of a second. Accordingly, this output is applied to the alarm circuit 92 where it is stretched for a predetermined length of time depending on how long one wishes the alarm to sound. The signal from the alarm circuit 92 is then applied to the alarm driver 94 where its is amplified so that it can activate the alarm 96.

The circuits used in various components of the receiver 38 are not part of this invention and will not be described in detail herein. However, suitable circuits for these components are described in detail in U.S. Pat. No. 4,476,459.

The clock 62, the counter-decoder 64, the pulse forming circuit 66, the power amplifier 68 and the transmitter antenna 32 all incorporate novel features of this invention and these circuits are shown in detail in FIG. 8.

The clock 62 is a 100 KHZ sine wave oscillator. It is made up of a pair of NPN type transistors Q20 and Q21 whose emitters are connected respectively through resistors R83 and R86 to a negative five volt terminal. A coil L3, is connected in parallel with series connected capacitors C47 and C48 and in parallel with series connected resistors R81 and R85 across the collectors of the transistors Q20 and Q21. The emitters and bases of the transistors Q20 and Q21 are cross coupled via series connected capacitor C50 and resistor R87 and series connected capacitor C46 and R80, respectively. The bases of the transitors Q20 and Q21 are also connected via resistors R82 and R88, respectively, to ground.

The 100 KHZ sine wave output is taken from the collector of the transistor Q21 and applied to a resistor R49 in the counter-decoder 64. The counter decoder comprises an integrated circuit U4 such as a Motorola MC14022B circuit.

Pin 14 of this circuit is connected to the resistor R49. Pin 16 is connected to a positive five volt terminal and is also connected via capacitor C55 to ground. The pin 15 is connected via series connected resistors 91 and 92 to ground and the pins 13 and 8 are connected directly to ground. The signals (c), (d), (g) and (h) are taken from pins 1, 4, 3, and 5 respectively and are supplied to the analog switch 82. The signals (a) and (e) are taken from pins 7 and 10 respectively. These signals are supplied to the pulse forming circuit 66.

The pulse forming circuit 66 comprises a pair of buffer transistor Q10 and Q11 of the NPN type. The collectors of these transistors are connected to a positive five volt terminal and they are also interconnected via a capacitor C56. The emitters of the transistors Q10 and Q11 are connected via a common resistor R59 to a negative five volt terminal. The signals (a) and (e) from the pins 7 and 10 of the integrated circuit U4 of the counter-decoder 64 are applied respectively to the bases of the buffer transistors Q10 and Q11. Outputs from these buffer transistors are taken from their emitters and are applied in parallel to separate differentiating circuits made up respectively of a capacitor C34 and associated series connected resistor R61 and a capacitor C35 and associated series connected resistor R64. The resistors R61 and R64 are connected to ground and the junctions between these resistors and their associated capacitors are connected respectively to the base terminals of further NPN type transistors Q12 and Q13. The emitters of these transistors are connected via a common resistor R65 to a negative five volt terminal; and the collectors of these transistors are connected directly to a positive five volt terminal.

Output signals from the pulse forming circuit 66 are taken from the emitters of the transistors Q12 and Q13 and are applied in parallel via associated resistors R63 and R66 to the bases of NPN type transistors Q14 and Q15 in the power amplifier 68. The emitters of these transistors are connected to ground and their collectors are connected in common through a diode CR12 and a series connected resistor R67 to a positive 24 volt source. This voltage source may be unregulated; and therefore, in order to smooth out any voltage fluctuations, a capacitor C53 is connected between the voltage source and ground.

Outputs from the power amplifier 68 are taken from a junction between the resistor R67 and the rectifier diode CR12; and these outputs are applied via a capacitor C52 to one end of the transmitter antenna 32. The other end of the transmitter antenna is connected to ground; and a capacitor C54 is connected between the two ends of the antenna. The capacitor C54 and the antenna 32 together form a resonant circuit.

In operation, the clock 62 generates a voltage at the emitter of the transistor Q21 which varies sinusoidally at 100 KHZ. This oscillating voltage is applied via the resistor R49 to pin 14 of the integrated circuit element U4 of the counter decoder 64. The element U4 converts the applied sinusoidal voltage to the pulses shown at a-h in FIG. 7. The pulses a and e are taken from pins 7 and 10 of the circuit U4 an are applied respectively to the bases of the buffer transistors Q10 and Q11 in the pulse forming circuit 64. The pulses a and e are then differentiated in the differentiators C34-R61 and C35-R64 and are amplified by the transistors Q12 and Q13. The values of the capacitors C34 and C35 (e.g. 100 picofarads) and of the resistors R61 and R64 (e.g. 750 ohms) provides an RC time constant of 0.075$\mu$ sec. which is substantially less than one half period of the 3.25 MHZ frequency of the resonant responder elements 12.

The differentiated pulse is amplified in the transistors Q12 and Q13 and is applied to the bases of the transistors Q14 and Q15 in the power amplifier 68. The transistors Q14 and Q15 serve as switches. Normally they are in their "off" or non-conducting condition so that their collectors as well as the junction between the diode CR12 and the resistor R67 remain at 24 volts. This imposes a 24 volt potential across the capacitor C52 which is connected between the junction and ground via the antenna 32 and via the capacitor C54. When, however, the transistors Q14 and Q15 are made to conduct during the 0.075$\mu$ sec. interval, the voltage at the junction between the diode CR12 and the resistor R67 drops accordingly and to this sudden voltage drop passes through the capacitor C52 and is applied to the antenna 32. The sudden drop and subsequent return of the potential at the junction between the diode CR12 and the resistor R67 is represented by curve A in FIG. 9. The diode CR12 protects the transistors Q14 and Q15 against reverse current flow at the trailing edge of each pulse.

The transmitter antenna 32 responds to this sudden voltage drop by experiencing a buildup in antenna current as shown at (i) in FIG. 9(B).

The antenna 32 is chosen to have an inductance of 2.8 microhenries and the capacitor C54 connected across the antenna is chosen to have a capacitance of 820 picofarads. As a result, the antenna 32 and the capacitor C54 together form a resonant circuit with a natural resonance frequency of about 3.25 megahertz.

Because the sharp voltage change applied from the power amplifier 68 to the antenna lasts less than one half period of the 3.25 MHZ frequency of the antenna resonant circuit, the antenna resonant circuit continues to resonate at 3.25 KHZ after the power amplifier transistors Q14 and Q15 are restored to their non-conducting state. The antenna circuit current is represented by the decaying sine wave (ii) shown in FIG. 9B. The envelope of this sine wave is shown by the heavy solid line (iii) in FIG. 9B. As can be seen from this line, the amplitude of the antenna current is brought to an initial high value by the occurrence of the pulse from the pulse forming circuit 66 and then the antenna current decays in an exponential manner. The rate of this decay is inversely proportional to the Q of the antenna resonant circuit and this Q is chosen to have a value such that the antenna resonates at an appreciable amplitude for about three to five cycles. Preferably, the antenna should have a Q of about 10.

Figure 9:
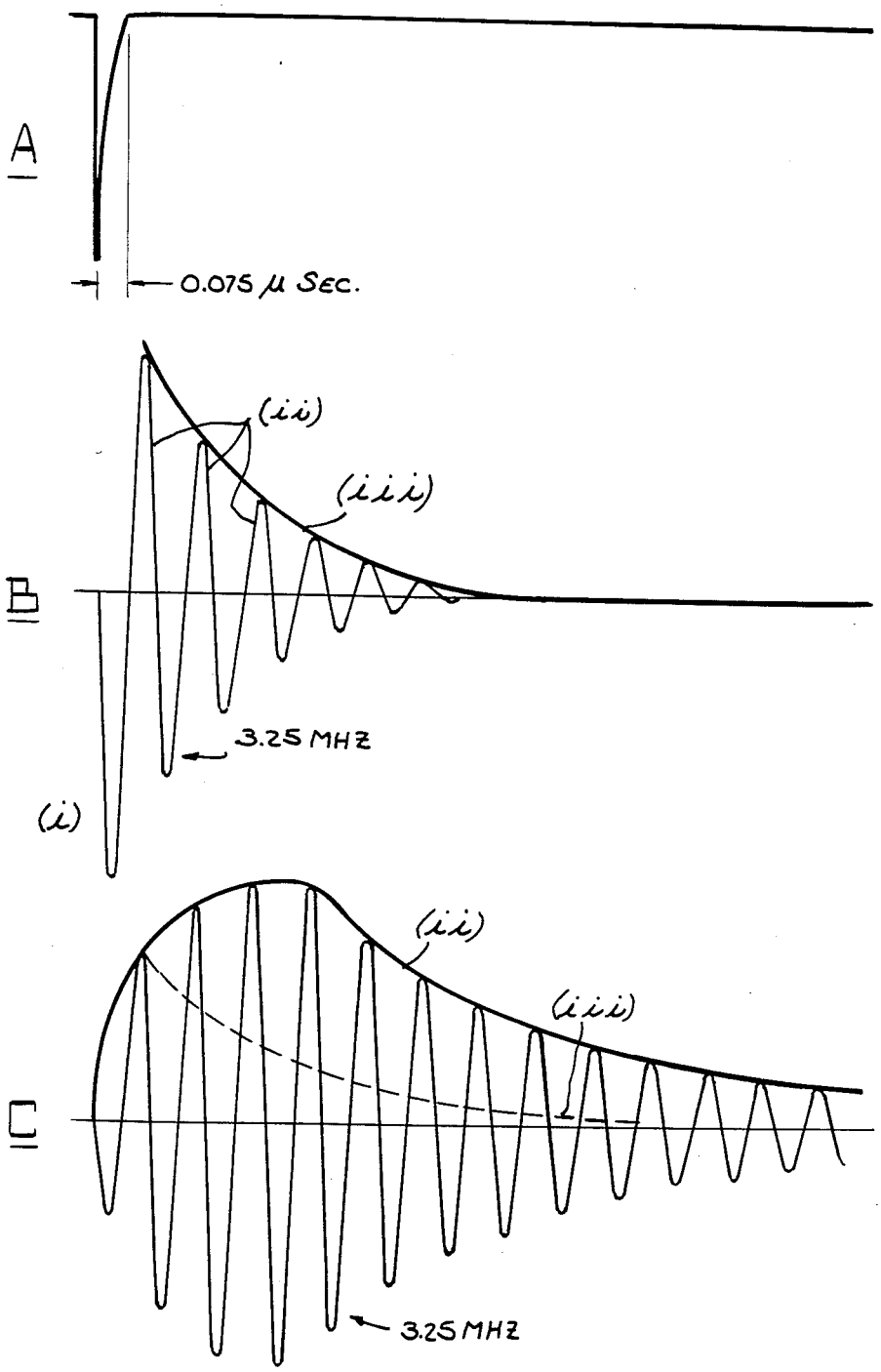
FIG. 9 is a series of waveforms useful in understanding the operation of the schematic of FIG. 8.

The effect of the resonating antenna on the resonant circuit in the responder element 12 is shown in waveform C of FIG. 9. The resonant responder circuit has a substantially higher Q than the antenna resonant circuit. For example, the resonant responder circuit may have a Q of about 120. As a result, the resonant responder circuit undergoes a much less pronounced decay than the resonant antenna circuit and it continues to resonate to produce detectable electromagnetic fields after the antenna circuit has ceased to resonate.

Because the resonant circuit in the responder element 12 has a high Q it requires a substantial exposure to electromagnetic fields at the proper frequency in order to be driven into high amplitude resonance. This substantial exposure is provided by the resonant antenna circuit which continues to resonant not just for one cycle but rather for three to five cycles. As can be seen in FIG. 9C the amplitude of the current in the resonant circuit of the responder element 12 builds up during the several cycles that the antenna circuit is resonating.

Thereafter, the current in the responder element experiences an exponential decay; but, because of its high Q, this decay is not so pronounced as in the case of the antenna resonant circuit.

The solid line (ii) in FIG. 9C represents the envelope of the current waves in the responder resonant circuit. The dashed line (iii) in FIG. 9C represents the envelope of the current wave in the resonant responder circuit in the case where the antenna circuit operates for only one half cycle. As can be seen, the resonant responder circuit in such case does not have an opportunity to build up a substantial amplitude of oscillation and consequently even though its decay is shallow it is at substantially lower amplitude than in the case where it is exposed to several cycles of antenna resonance.

It will be appreciated that no oscillator is used to drive the antenna in this invention. In this respect this invention differs from those prior art systems which incorporate a resonant antenna circuit into an oscillator. The antenna driving arrangements of this invention are more simple and more energy efficient than those which incorporate an oscillator. On the other hand this invention differs from those prior art arrangements which simply pulse a non-resonant antenna so that it produces a signal having a duration less than one period of the frequency of the resonant responder circuit. As explained above, this invention makes it possible to expose the resonant responder circuits to the interrogation signal for a longer period of time so that the amplitude of their response is greatly enhanced. Furthermore, by generating an interrogation signal in the form of a sine wave at or very near the resonant frequency of the responder circuit, the energy contained in the interrogation signal is concentrated near the responder circuit resonant frequency and a much larger portion of the energy of the interrogation signal is used to interrogate the responder circuit than is used when a single short pulse is used for interrogation.

By way of example, the following values may be used for the various circuit elements in the clock 62, the counter decoder 64, the pulse forming circuit 66 and the power amplifier 68:

| Clock 62 | | | |
|---|---|---|---|
| C46 = 0.01 | μf* | R80 = 47K ohms | R86 = 4.3K ohms |
| C47 = 0.0068 | μf | R81 = 12K ohms | R87 = 47K ohms |
| C48 = 0.0068 | μf | R82 = 10K ohms | R88 = 10K ohms |
| C49 = 0.1 | μf | R83 = 4.3K ohms | |
| C50 = 0.01 | μf | R84 = 330 ohms | |
| C51 = 0.01 | μf | R85 = 12K ohms | |
| L3 = 0.77 microhenries | | | |
| Q20 = MPS5172 | | | |
| Q21 = MPS5172 | | | |
| COUNTER DECODER 64 | | | |
| C55 = 15 μf | | | |
| R91 = 3.3K ohms | | | |
| R92 = 1K ohms | | | |
| U4 = MC140022B (Motorola Semiconductor Products, 5005 East McDowell Road, Phoenix, Arizona 85008) | | | |
| PULSE FORMING CIRCUIT 66 | | | |
| C34 = 100 picofarads | | | R59 = 510 ohms |
| C35 = 100 picofarads | | | R61 = 750 ohms |
| C56 = 15 μf | | | R64 = 750 ohms |
| | | | R65 = 470 ohms |
| Q10 = MPS5172 | | | Q12 = MPS5172 |
| Q11 = MPS5172 | | | Q13 = MPS5172 |
| POWER AMPLIFIER 68 | | | |
| C52 = 0.1 μf | | | R63 = 10 ohms |
| C53 = 0.1 μf | | | R66 = 10 ohms |
| | | | R67 = 430 ohms |
| CR12 = IN914 | | | |
| Q14 = 2N2219A | | | |
| Q15 = 2N2219A | | | |

*μf = microfarads

The values of these circuit elements can of course be modified depending on the frequencies used, as will be apparent to those skilled in the art.

It will be appreciated from the foregoing that there has been described a novel, self-contained theft detection system having an interrogation circuit which is simple and economical and which at the same time provides maximum energy for driving responder circuits into resonance.

I claim:

1. In an electronic theft detection apparatus for detecting the unauthorized movement of protected articles through a passageway, said apparatus comprising a transmitter for producing electromagnetic waves in said passageway, electronic responder circuits constructed and arranged to be mounted on protected articles and to produce a characteristic disturbance of said electromagnetic waves when one of said articles is present in said passageway and a receiver constructed and arranged to sense the occurrence of said characteristic disturbance of said electromagnetic waves when one of said articles is present in said passageway and to produce an alarm in response thereto, the combination of a transmitter antenna connected to said transmitter and a receiver antenna connected to said receiver, one of said antennas comprising a loop of an electrically conductive, non magnetic, self supporting material and the other antenna comprising an electrically conductive wire loop supported by said self supporting material.

2. Electronic theft detection apparatus according to claim 1 wherein said loop of electrically conductive, non magnetic material of said one antenna is formed of tubular material and the other antenna extends inside said tubular material.

3. Electronic theft detection apparatus according to claim 1 wherein said one antenna is connected to said transmitter and said other antenna is connected to said receiver.

4. Electronic theft detection apparatus according to claim 2 wherein said loop formed of tubular material has associated therewith a tubular element which bisects said loop, wherein a portion of said electrically conductive wire loop extends through said tubular element and wherein said electrically conductive wire loop is made up of two bucking loop portions.

5. Electronic theft detection apparatus according to claim 2 wherein said transmitter and receiver are contained within a common housing and wherein said tubular material is secured near its ends to said housing.

6. Electronic theft detection apparatus according to claim 5 wherein the ends of said loop of tubular material extend through the sides of said housing and are electrically insulated therefrom and are connected inside said housing to said transmitter.

7. Electronic theft detection apparatus according to claim 6 wherein said other antenna comprises an insulated wire extending through said tubular material and connected inside said housing to said receiver.

8. Electronic theft detection apparatus according to claim 7 wherein said loop of tubular material further includes an extension of tubular material which extends from the center of said loop to said housing and wherein said other antenna extends completely around the interior of said loop of tubular material and through said housing and also has an extension which extends through said extension of tubular material and is connected to said other antenna at each end thereof inside said housing and at the center of said loop, respectively, and wherein said extension of said other antenna is broken inside said housing and its ends are connected to said receiver.

9. An electronic theft detection apparatus for detecting the unauthorized movement of protected articles through a passageway, said apparatus comprising a transmitter for producing in said passageway successive bursts of electromagnetic wave energy at a predetermined frequency, responder elements constructed and arranged to be fastened to articles which may be carried through said passageway, said responder elements containing resonant electrical responder circuits tuned to resonate at said predetermined frequency, a receiver positioned and arranged to respond to electromagnetic wave energy at said predetermined frequency which occurs in said passageway in the intervals between successive bursts from said transmitter, said transmitter having a resonant antenna circuit which comprises a loop of electrically conductive material and a capacitor connected to said loop and tuned to resonate with the loop at said predetermined frequency, the Q value of said resonant antenna circuit being substantially less than the Q value of said resonant responder circuits and a pulse generator connected to apply to said resonant antenna circuit voltage pulses having a duration less than one cycle of said predetermined frequency to cause said resonant antenna circuit to resonate in a decaying manner for a number of cycles at said predetermined frequency.

10. Electronic theft detection apparatus according to claim 9 wherein said loop of electrically conductive material of said resonant antenna circuit of said tranmitter is a rigid self supporting material and wherein said capacitor is connected across the ends of the loop.

11. Electronic theft detection apparatus according to claim 9 wherein said pulse generator comprises means for generating a series of clock pulses, a differentiator circuit for generating sharp voltage spikes from said clock pulses and an amplifier for amplifying said sharp voltage spikes and applying the amplified sharp voltage spikes as said voltage pulses to said resonant antenna circuit of said transmitter.

12. Electronic theft detection apparatus according to claim 11 wherein said amplified voltage spikes have a duration less than one half period of said predetermined frequency.

13. Electronic theft detection apparatus according to claim 11 wherein said amplifier comprises an electrical switch connected in series with a resistor between a voltage source and ground and wherein one end of said resonant antenna circuit of said transmitter is connected to a junction between said switch and said resistor.

14. Electronic theft detection apparatus according to claim 13 wherein a further capacitor is interposed between said junction and said resonant antenna circuit of said transmitter.

* * * * *